US008919225B2

(12) United States Patent
Row

(10) Patent No.: US 8,919,225 B2
(45) Date of Patent: Dec. 30, 2014

(54) ADJUSTABLE SOCKET FOR A RATCHET WRENCH

(71) Applicant: Chi Sung Row, Norcross, GA (US)

(72) Inventor: Chi Sung Row, Norcross, GA (US)

( * ) Notice: Subject to any disclaimer, the term of this patent is extended or adjusted under 35 U.S.C. 154(b) by 210 days.

(21) Appl. No.: 13/764,735

(22) Filed: Feb. 11, 2013

(65) Prior Publication Data

US 2014/0224073 A1 Aug. 14, 2014

(51) Int. Cl.
*B25B 13/10* (2006.01)
*B25B 13/44* (2006.01)

(52) U.S. Cl.
CPC ..... *B25B 13/10* (2013.01); *B25B 13/44* (2013.01)
USPC ..... 81/52

(58) Field of Classification Search
USPC ..... 81/52, 90.3; 294/86.11, 86.4, 99.1
See application file for complete search history.

(56) References Cited

U.S. PATENT DOCUMENTS

| | | | | |
|---|---|---|---|---|
| 1,327,702 | A | 1/1920 | Clark | |
| 2,984,134 | A * | 5/1961 | Modin | 81/52 |
| 4,112,792 | A | 9/1978 | Guimarin | |
| 4,676,125 | A | 6/1987 | Ardelean | |
| 4,905,548 | A | 3/1990 | Colace et al. | |
| 5,377,566 | A | 1/1995 | Mandigo | |
| 6,971,284 | B2 | 12/2005 | Owoc | |

FOREIGN PATENT DOCUMENTS

| | | |
|---|---|---|
| EP | 0047240 | 7/1984 |

* cited by examiner

*Primary Examiner* — David B Thomas
(74) *Attorney, Agent, or Firm* — Mark Loen

(57) ABSTRACT

The adjustable socket design uses a weave of cables to position six arms which are used to torque a nut. The arms have a gripping surface to torque the nut. The design also allows for a quick and easy size adjustment. When the top of the socket is separated from the bottom, the two parts are twisted relative to each other which moves the arm positions to accommodate different nut sizes. When the top and bottom of the socket are pushed together, they fix the arm positions and the socket is used as a traditional fixed sized socket.

4 Claims, 11 Drawing Sheets

ADJUSTABLE SOCKET FOR A RATCHET WRENCH

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This description is directed toward sockets used in ratchet wrenches for tightening nuts and bolts. In particular, it is directed toward convenient methods to vary the size of the socket in order to adjust a variety of nut/bolt sizes without changing the tool.

(2) Description of Related Art

Others have designed variable sized tools that are adjustable for varying nut sizes. For example, U.S. Pat. No. 3,339,439 is an example of a varying socket that requires the user to maintain downward pressure to work. This can be an inconvenience when tightening or loosening a nut. Though this method is simple, its usefulness is limited due to the fact that downward pressure is required for it to work correctly.

Another example is U.S. Pat. No. 4,022,086 where the adjustable socket is a pivoting opening between two members that pivot about a pin. Another member adjusts the opening and torque is transferred through keys. Where this provides important flexibility, the length required does not fit well within needs of common socket parts and requires a lot of overhead distance.

Another example is U.S. Pat. No. 4,366,732 which is another gripping jaw design. Axial force onto the pressure is not needed to make the gripping force maintained. However, the resulting method requires a lot of complicated and intricately made parts.

Other existing adjustable socket patents are designs where movable sides are wedged into position so as to be able to apply torque to different sized nuts.

BRIEF SUMMARY OF THE INVENTION

The present design uses a weave of cables to position six arms which are used to torque a nut. The nut is gripped on the flat sides and not at the corners. This prevents rounding at the corners and allows for higher torque applications.

The design also allows for a quick and easy adjustment of the size setting. The adjustable socket operates in two different modes: size adjustment and operational. When the top assembly of the socket is separated from the bottom assembly, it is in size adjustment mode. In the adjustment mode, the top and the bottom portions of the socket body are twisted relative to each other and the arms can be moved in and out to accommodate different nut sizes. When the top and bottom assemblies of the socket are pushed back together, it is in operational mode and the socket is used as a traditional fixed sized socket.

BRIEF DESCRIPTION OF THE SEVERAL VIEWS OF THE DRAWING(S)

Figure 9A:
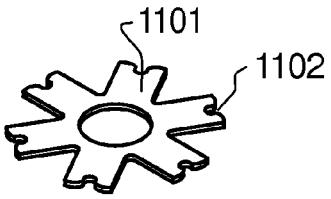
Figure 9B:
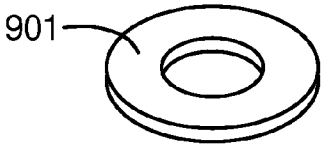

FIGS. 9A-B shows the spring plate and the locking ring.

Figure 10:
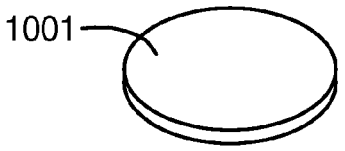

FIG. 10 shows the stop plate.

Figure 11A:
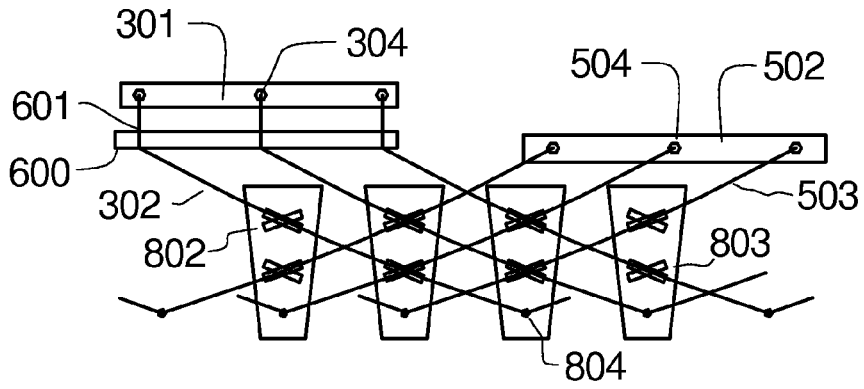
Figure 11B:
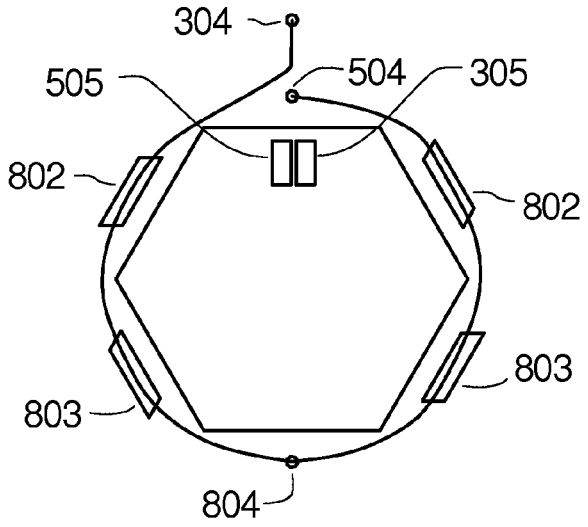

FIGS. 11A-11B show the cable system which includes a weave and guide system for positioning the arms in a simplified format.

Figure 12A:
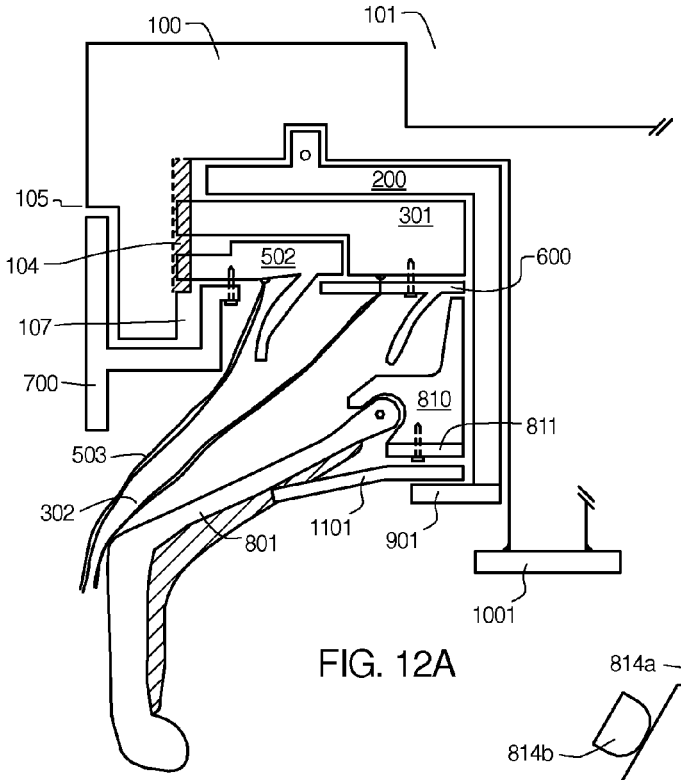
Figure 12B:
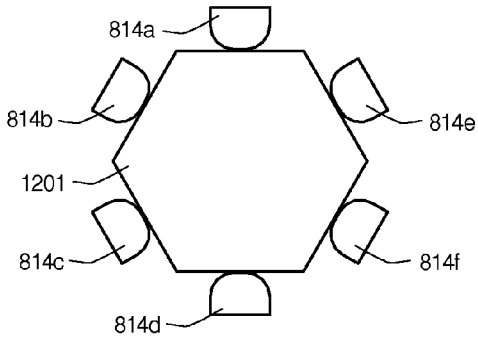

FIGS. 12A-12B show details of the arm assembly into the arm carrier via cross sectional views.

Figure 13:
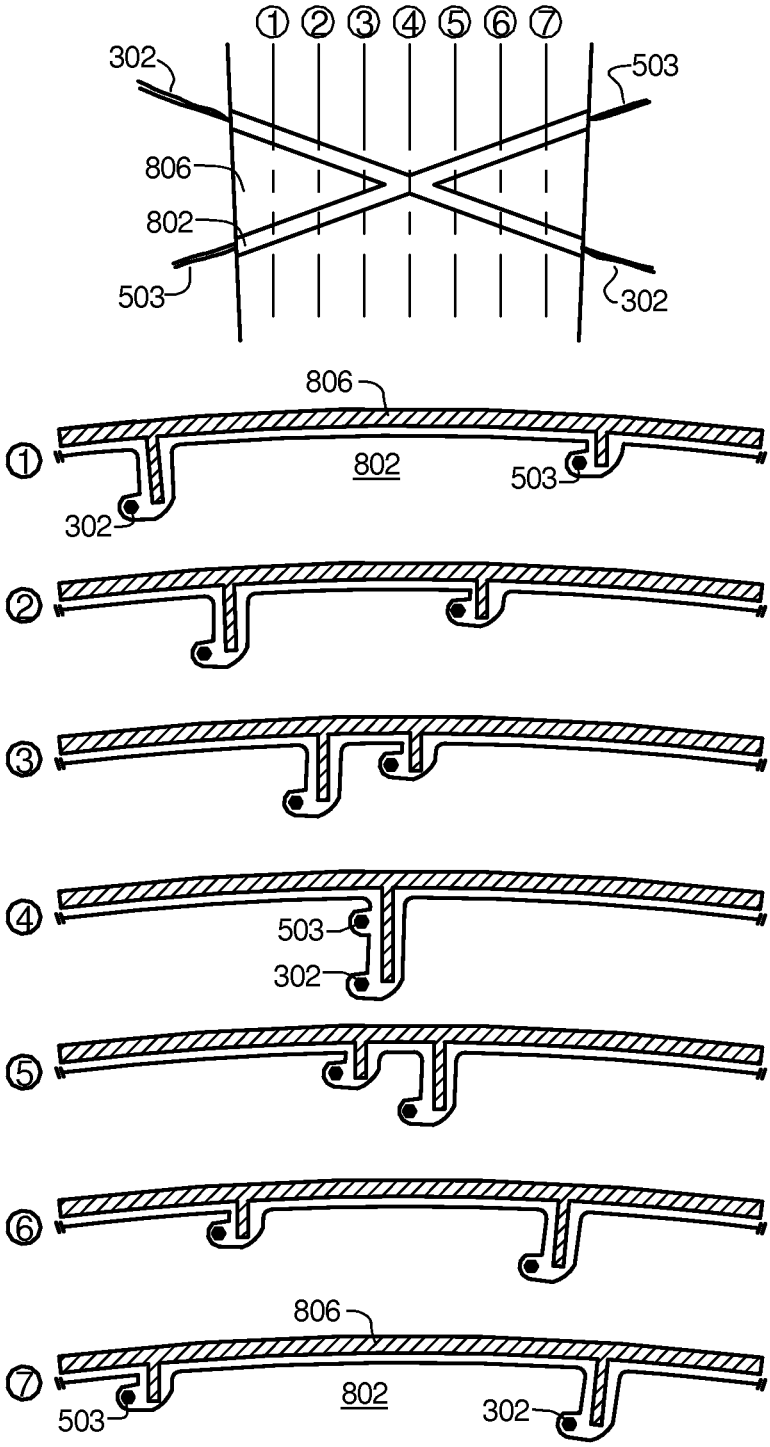

FIG. 13 shows a typical cable guide cross sections.

Figure 14:
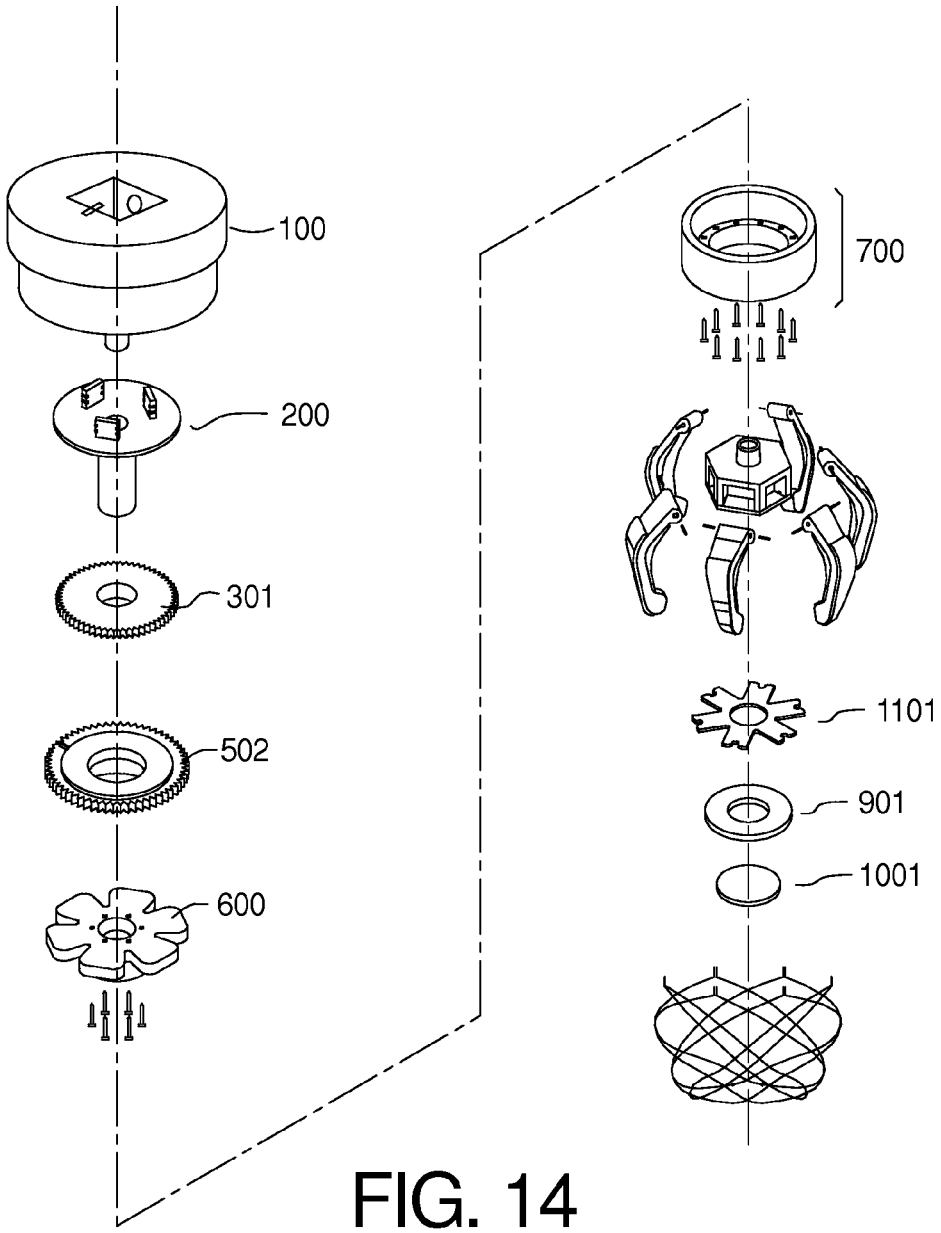

FIG. 14 shows an assembly view of the main embodiment.

DETAILED DESCRIPTION OF THE INVENTION

The features of the preferred embodiment of the adjustable socket are useful for attaching to the end of a ratchet wrench, and its useful extensions as needed, to fit over a nut or bolt head. The embodiment discloses the use of six arms, which is useful for a hex nut, although this is not a strict requirement and four arms could equally be used for a square nut. A square nut would only require re-working the geometry of the arm carrier from a hexagonal to a square so as to accommodate a square nut.

The preferred embodiment is designed to simplify the process of changing sizes between nuts. To change sizes, the adjustable socket is designed to separate into two parts. They are pulled apart and twisted relative to each other. This tightens or loosens the cable weave around the arms causing the arms to move toward or away from each other. Then the two adjustable socket parts are then pushed back together to lock the arms at the new position (i.e. new nut size). A trial and error approach can be used to get the nut size exactly right or bolt size markings may be imprinted on the outside of the adjustable socket (see FIG. 4).

To aid the reader, the following labels in the figures are identified as follows:

| Item | Description |
|---|---|
| 100 | socket top |
| 101 | rectangular opening |
| 102 | center post |
| 103 | rectangular openings |
| 104 | top socket gear teeth |
| 105 | diameter change |
| 106 | detent balls |
| 107 | smooth ring |
| 200 | carrier |
| 201 | tube |
| 202 | insert posts |
| 301 | top gear plate |
| 302 | top gear plate wires |
| 304 | top gear plate wire attachment |
| 305 | top gear plate rotational stop |
| 306 | top gear plate disc |

-continued

| Item | Description |
|---|---|
| 401 | upper half socket assembly |
| 402 | lower half socket assembly |
| 501 | raised disk |
| 502 | bottom gear plate |
| 503 | bottom gear plate wires |
| 504 | wire attachment |
| 505 | bottom gear plate rotational stop |
| 506 | holes |
| 507 | wire guide |
| 600 | cable guide plate |
| 601 | cable slots |
| 603 | wire guide |
| 700 | socket bottom |
| 701 | side ring |
| 801 | movable arm |
| 802, 803 | cable guides |
| 804 | cable termination point |
| 805 | rod or pin |
| 806, 807 | guide covers |
| 810 | arm carrier |
| 811 | arm carrier bottom plate |
| 812 | slot |
| 813 | lip |
| 814 | arm bottom end |
| 815 | spacer tube |
| 816 | arm rib |
| 901 | locking ring |
| 1001 | stop plate |
| 1101 | spring plate |
| 1102 | groove |
| 1201 | nut |

Figure 1A:
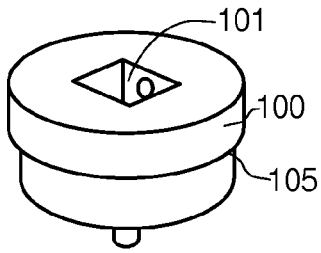
FIGS. 1A-1F shows the body of the socket wrench and details of the inside.

In FIG. 1A, the socket top 100 is shown. It has a common female rectangular opening 101 to accept the male end of a socket wrench. The socket preferably changes in diameter 105 somewhere near the midpoint of the sidewall. The change in diameter feature is shown, but is not a required feature. The top view of socket top 100 is shown in FIG. 1C.

Figure 1B:
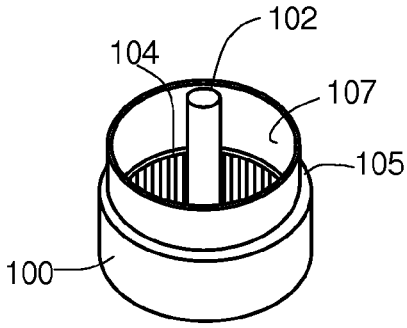

In FIG. 1B, an isometric view of the socket top 100 is seen from the bottom, inside the part. A center post 102 is shown. Also along the inner wall, as viewed, some portion from the bottom of it is covered in gear teeth 104. Above the gear teeth, there is a smooth ring area 107.

Figure 1F:
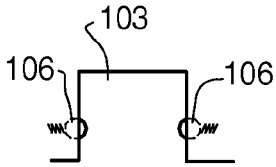
Figure 1C:
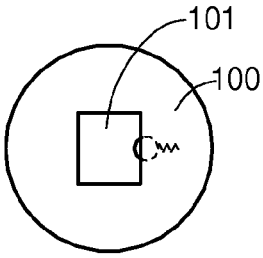
Figure 1D:
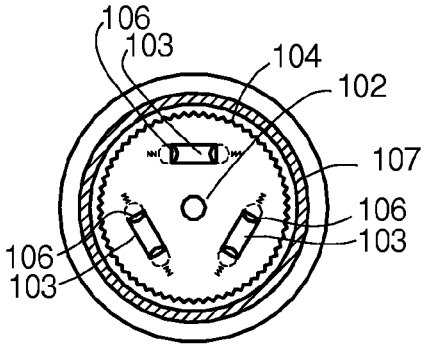

In FIG. 1D, viewing directly at the socket top 100 from the bottom, there are three rectangular openings 103. These openings contain captured detent balls 106 in the sides with springs behind them. (Also illustrated in FIG. 1F).

Figure 1E:
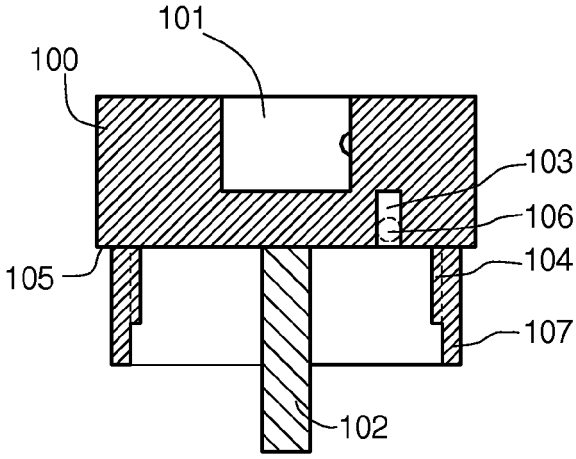

In FIG. 1E, a somewhat enlarged cross sectional view of FIG. 1A is shown. It would also be a horizontal sectional cut of FIG. 1D.

In an assembly, the socket top 100 is upside down as shown in FIG. 1B and is used to hold all the parts.

A carrier 200 used to hold the inner parts in place and also to allow axial movement of the two parts of the socket when the socket top is pulled up or pushed down. Moving the socket top up or down is the method of adjusting the socket for the bolt size.

Figure 2A:
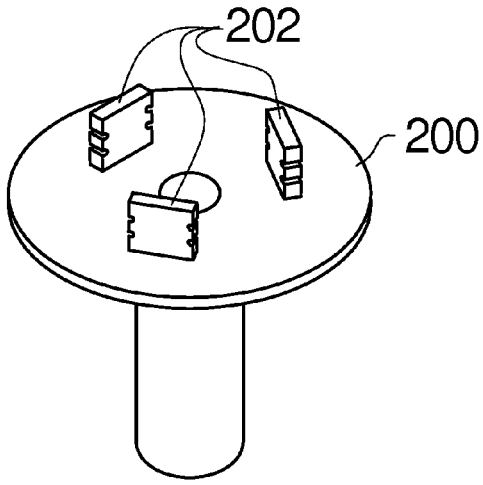
FIGS. 2A-2C show a carrier that is used to hold the inner parts in place.
Figure 2B:
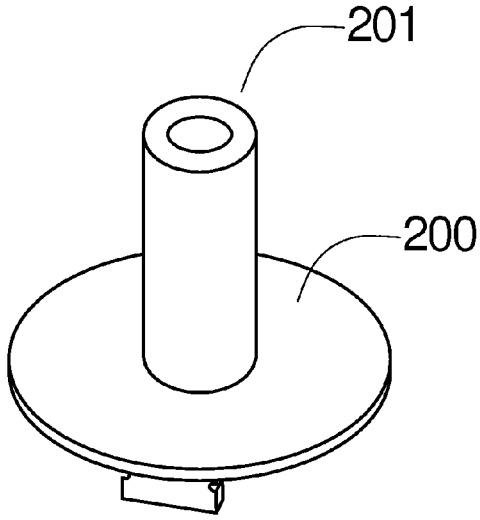
Figure 2C:
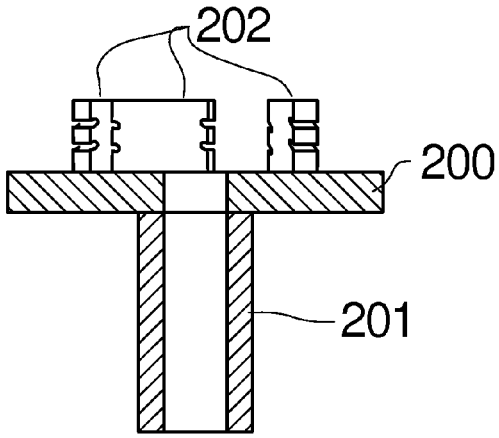

A tube 201 slides over the center post 102 of the socket top 100 (not shown in FIG. 2). The three insert posts 202 slide into the openings 103 of the socket top 100. The notches of the side of the posts 202 will engage the detent balls inside the opening 103 to provide two positions stops for the two operational modes; adjustment or normal.

Figure 3A:
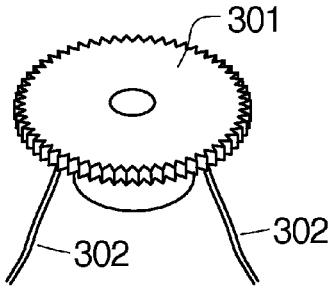
FIGS. 3A-3D show the top gear plate.

FIG. 3A shows the top gear plate 301. This is the top gear plate and it is assembled by sliding down the tube 201 portion of the carrier 200. The side of the plate is covered in gear teeth which match the socket top gear teeth 104.

Figure 3B:
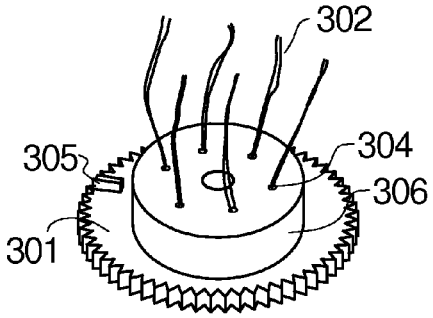
Figure 3C:
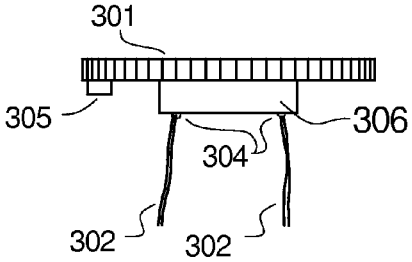
Figure 3D:
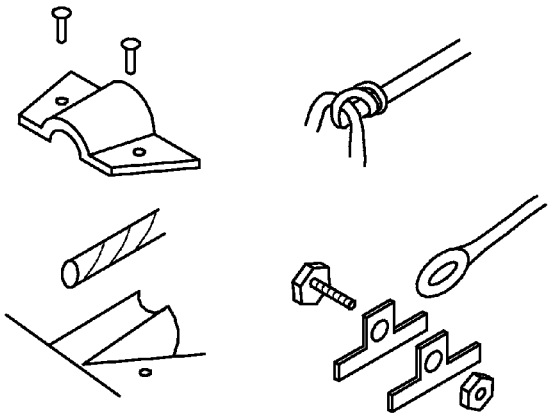

In FIG. 3B you see the opposite view or bottom view of the top gear plate. The underside of the plate has a rotational stop 305. Also on the bottom, there are 6 wires 302, made from wire, cable, or ropes, which are attached to a gear plate disc 306. The wires could be music wire, wire ropes, or synthetic cables. The wire is attached to the top gear plate 304 by any of welding, clamping, winding, or capturing a built-in loop. Possible attachment options are shown in FIG. 3D. The attachment is preferably at an angle to alleviate the first bend in the wire.

Figure 4:
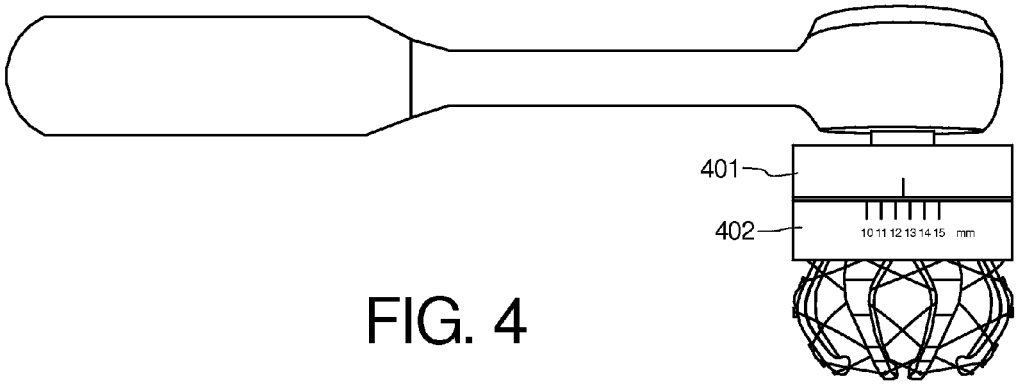
FIG. 4 shows the assembled part in place on a ratchet wrench.

FIG. 4 shows the assembled part in place on a ratchet wrench. An upper half of the socket assembly 401 is pulled away from the lower half of the socket assembly 402 in order to change nut sizes. The lower half is then twisted (i.e. rotated) relative to the upper half which causes the cable system to change the position of the arms which contact the nut faces. The two halves are then pushed back together to lock the new size in place. As will be seen later in FIG. 12A, the socket bottom 700 and the socket top 100 are the parts that are grasped by the user for size adjustment.

Figure 5A:
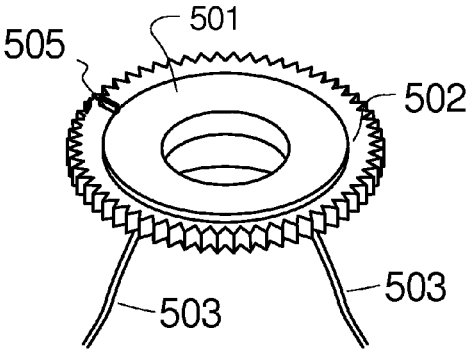
FIGS. 5A-5C show the bottom gear plate.
Figure 5B:
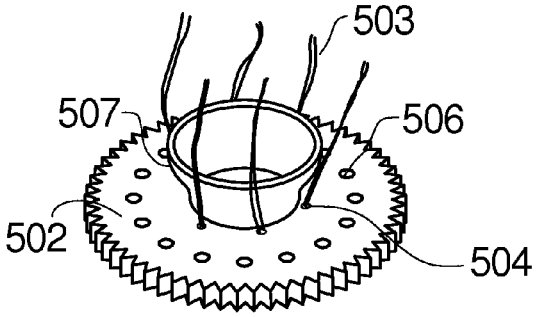
Figure 5C:
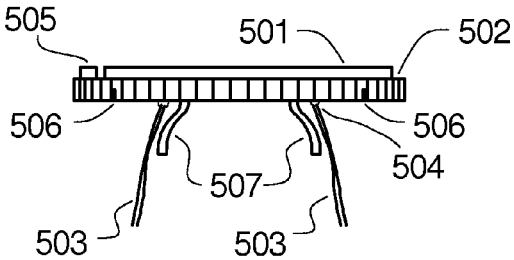

FIG. 5A shows the bottom gear plate 502. It's similar to the top gear plate 301 except the center opening is much wider and the raised disk 501 is at the top on the same side as the bottom gear plate rotational stop 505. On the bottom of the plate, there are six wire attachment points 504 (again cable, wire rope, or synthetic rope) attached in a similar fashion to the top plate 304 attachment shown in FIG. 3D. Again, the preferred attachment angle will be to the side except it will be opposite of the top plate's direction. A wire guide 507 shaped like a bell is used to orient and control the bottom gear plate wires 503 during assembly and in adjustment operation. On the edge of the bottom gear plate 505 will be gear teeth. During the assembly, the bottom gear plate slides over the top gear plate disk 306 and the raised disk 501 rests against the bottom of top gear plate 301.

It is important to place the stop 505 next to the upper stops 305 in the correct location during the assembly as shown in FIG. 11B.

Figure 6A:
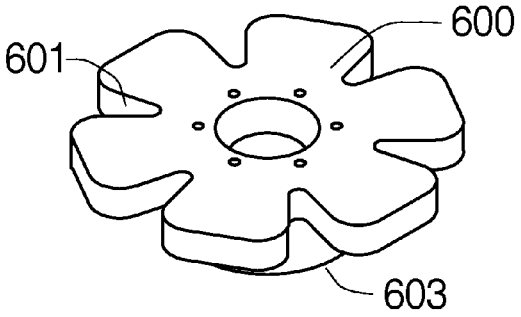
FIGS. 6A-6C show the cable guide plate.
Figure 6B:
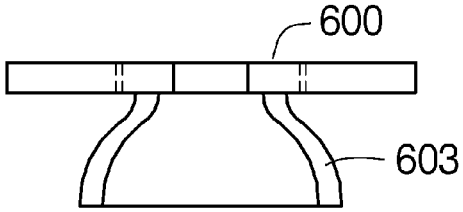
Figure 6C:
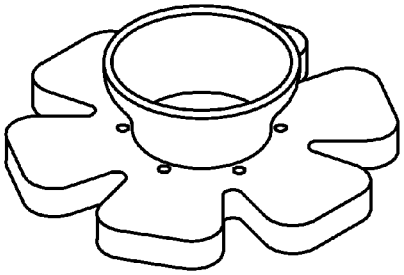

The cable guide plate 600 is shown in FIG. 6A. There are six cable slots 601 on the cable guide plate in the preferred embodiment being discussed. Through these slots, the top gear plate wires 302 are passed through. A wire guide 603 shaped like a bell is used to guide the wires 302 from the top gear plate. During assembly the cable guide plate slides over the tube 201, and the top of the cable guide plate (as viewed in FIG. 6A) assembles against the bottom of top gear plate disk 306. In this position, some portion of the inner edge of bottom gear plate 502 overlaps the outer edge of the cable guide plate 600 and the bottom gear plate 502 is captured in place (see FIG. 12A).

Figure 7A:
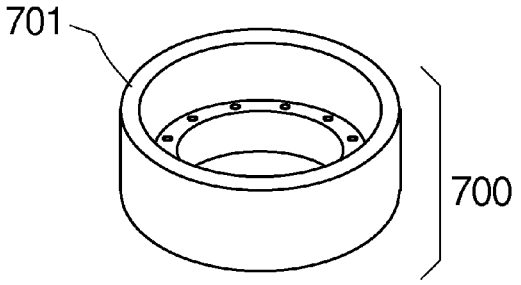
FIGS. 7A-7B show the socket bottom.
Figure 7B:
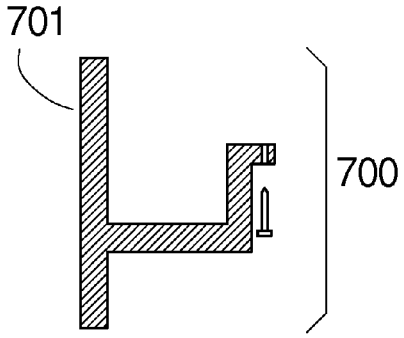

FIGS. 7A-7B show the socket bottom 700. The socket bottom 700 assembles next to the bottom gear plate 502 and is screwed in place 506. The side ring 701 is tall enough to reach the diameter change position 105 of the socket top in the operating position. On the outside of the side ring 701, there are markings showing the typical nut/bolt size adjustment location when matched against the marking on the socket top 100 (See FIG. 4).

The position of the screw hole locations 506 are keyed such that the socket bottom will only fit in the correct orientation.

Figure 8A:
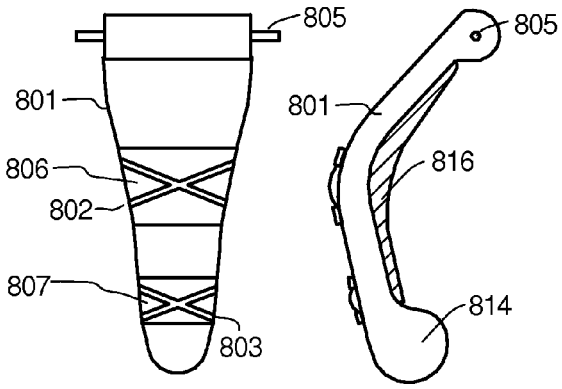
FIGS. 8A-8I show the details of a movable arm and its assembly into the arm carrier.

FIGS. 8A-8G show the details of a movable arm 801 and other important details related to the movable arms. In FIG. 8A, the movable arm 801 is tapered in shape when viewed from the front toward the bottom. It is also smoothly curved from the top to the bottom as shown and includes an inside arm rib 816 for strength. The top contains an area for a rod/pin 805 and the bottom end 814 is formed into an elongated semicircular shape. This is the area which makes the contact with the nut/bolt.

Figure 8B:
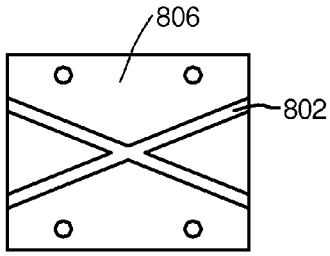
Figure 8C:
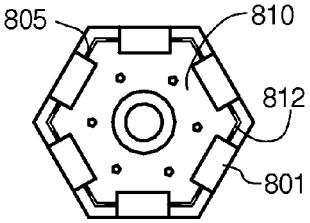
Figure 8D:
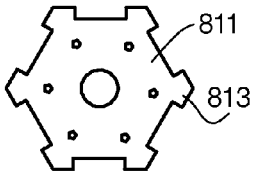
Figure 8F:
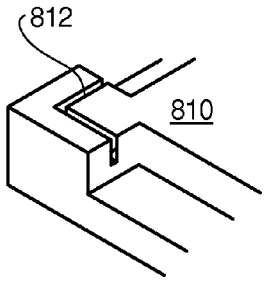
Figure 8E:
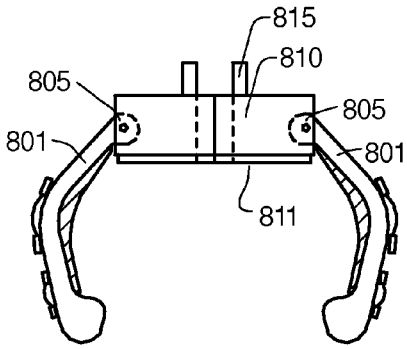
Figure 8G:
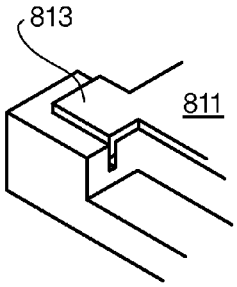

In FIG. 8E, in the preferred embodiment being discussed there are six arms attached to the arm carrier 810 which is hexagonal in shape, but only two arms are shown to simplify the illustration. A rod or pin 805 goes through the top of the arm and rests in a slot 812. The folded lip 813 of the bottom carrier plate is placed on top of the rod 805 and holds the arms in place. The bottom carrier plate 811 is attached to the arm carrier 810 as shown in FIG. 8E. Screws are preferably used in attaching the bottom plate. A snap in design could also be used.

On the outside of each arm 801, there are two cable guide grooves 802, 803. They are machined in a groove as a semi-circular tube shape and they make an 'x' shape between the top and the bottom guides as shown in FIG. 8B. On top of each guide area, a guide cover 806, 807 is screwed in place once the wires are routed through the cable guides 802, 803. The guide covers 806, 807 have protruding rails underneath which will fit into the grooves of the two cable guide grooves 802, 803 (see FIG. 13).

Figure 8H:
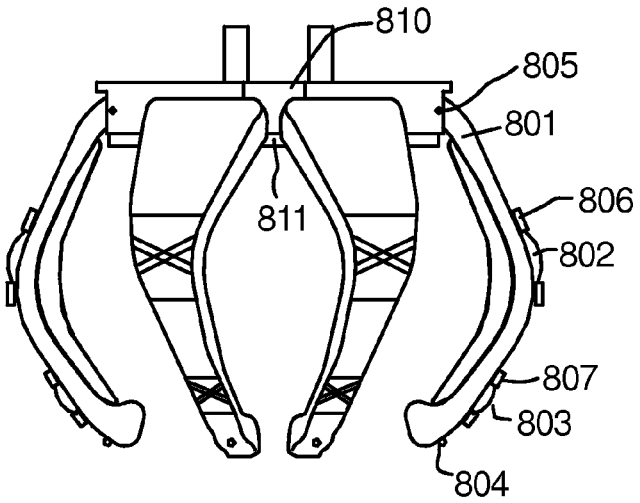
Figure 8I:
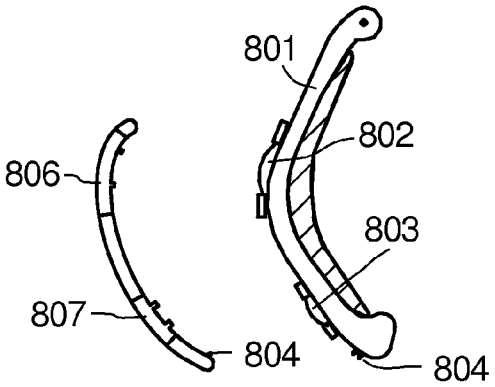

Assembled arms are shown in FIG. 8H. This assembly will slide in on the tube 201 via an opening in the arm carrier 810. FIG. 8I shows the two guide cover 806, 807 as an entire assembly, although each cover could be separately made.

A spring plate 1101 (shown in FIG. 9A) made out of flat spring steel slides onto the tube 201 below the arms assembly. The spring plate is positioned such that each forked groove 1102 will fit on the inside rib 816 of each arm 801. In another variation, more than one spring plates of different diameter are installed on top of each other to form a "leaf spring" effect with smaller diameter plates below the larger diameter plates.

Once the spring plate 1101 is in place, the locking ring 901 (FIG. 9B) is put in place on the tube 201 and then welded in place to lock all the plates in place. This completes the assembly of the plates to the carrier 200.

At the bottom of the rod 102 a stop plate 1001 (FIG. 10) is welded in place.

FIG. 11A shows part of the cable system where the weaving pattern of the wires are used to adjust the position of the arms for different size bolts/nuts. There are total of 12 wires: 6 wires running clockwise and 6 wires running counter clockwise.

Looking at the wire from the top of the socket, the wires from the bottom gear plate 502 run clockwise from the attachment point 504 to cable termination point 804 and the wires from the top gear plate 301 run counter clockwise from the attachment point 304 to cable termination point 804.

All the wires terminate at the bottom of a cable termination point 804 on the movable arm. From there, it is routed through the lower cable guide 803 of the arm next to it and then through the upper cable guide 802 of the arm next to it in a continuing direction.

The bottom gear plate wires 503 are terminated at an attachment point 504 as illustrated. The top gear plate wires 302 are first routed through cable slots 601 in the cable guide plate 600 and are terminated at the attachment point 304.

After wires are weaved into place, cable guide covers 806, 807 are screwed in place and the final termination of the wires 302, 503 are carried out at the cable termination point 804. Again the type of termination would depend upon the type wire being used. The termination would be similar to the termination 304, 504 except that the termination would be parallel to the surface running horizontally. A variation in design would combine both guide covers 806, 807 as a single piece. Another variation would combine both guide covers 806, 807, and the termination crimping cover for (if crimping is used as the termination method) as a single unit. (See FIG. 8I)

The weaving of the wire is performed when the arms are opened to the maximum amount and the gear plates are at the stop location in the proper position. The maximum outward movement of the arm is controlled by the shape of the arm carrier 810 overhang. It is expected the bottom sides of the arms will be nearly perpendicular when the socket is at the maximum sized position.

From the stopped position, as the top and the bottom of the socket is rotated relative to each other, the cables will cause the weave to tighten the arms, draw them closer together, and pull the arms toward each other to form a smaller opening for smaller size nut/bolts. When the top and the bottom are rotated in the opposite direction, the cable weave will loosen and push out the arms to accommodate larger size nut/bolts. The spring plate 1101 will aid in extending the arms outward by providing outward force against the arms. FIG. 11B illustrates that the weave of the wire is actually in a circumferential direction around the arms, even though FIG. 11A illustrates it as more of a two dimensional geometry.

FIG. 12A shows a partial side cut view of the adjustable socket assembly. For clarity, the cable weave is not shown. This drawing shows the normal operational state. Both the top gear plate 301 and the bottom gear plate 502 are locked in place by the engagement of the gears with the socket top inside gear teeth 104.

In this position, a torque applied from a socket wrench through the rectangular opening 101 will be transferred to the gear plates 301, 502 which in turn pulls on the set of wires 302, or 503. The wires in turn will pull against the cable termination point 804 and at the same time keep the arms in place. The end result is that when torque is applied to the rectangular opening 101, the arms will apply torque to the bolt/nut.

To adjust to a different size nut/bolt, the top of the socket top 100 is pulled up to release the bottom gear plate 502 from the inside gear ring to the open area 107. The separated parts of the socket assembly are then twisted relative to each other to adjust the movable arm 814*a-f* position so they touch the middle of each face of a nut/bolt 1201 as shown in FIG. 12B. Once the correct size adjustment has been set, the socket top 100 then can be pushed down to engage the bottom gear plate 502 in a locked position. The relative rotation between the top gear plate 301 and the bottom gear plate 502 tightens or loosens the cable wire weave, which in turn, adjusts the position of the movable arms.

At the top of FIG. 13, the upper cable guide cut shape is seen. Seven cross sectional areas across the upper cable guide are shown. As you can see, the cable groove follows two separate machined surfaces and is kept at two different levels. This allows the two cables to be routed through the guide without entanglement.

FIG. 14 shows an isometric view of an assembly of a preferred embodiment. Certain attaching screws were omitted for clarity of illustration.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

I claim:

1. An adjustable socket assembly for a ratchet wrench useful for torqueing a nut comprising:

a) movable arms, wherein said movable arms are designed to contact each face of said nut, b) a cable system, 1) wherein said cable system is attached to said movable arms and is designed to adjust the position of said movable arms for varying sizes of nuts, and 2) wherein said cable system is designed to be adjusted by the relative rotation of two parts, and c) cable guides, wherein said cable guides are incorporated into said movable arms.

2. The adjustable socket assembly according to claim 1 wherein a) said cable system is attached to a top gear plate, b) said cable system is attached to a bottom gear plate, c) said top gear plate and said bottom gear plate are fitted inside a socket top, and d) wherein said cable system is designed to be adjusted by the relative rotation of said top gear plate and said bottom gear plate.

3. The adjustable socket assembly according to claim 2 wherein a) said movable arms are attached to an arm carrier, and b) wherein said arm carrier is fitted inside said socket top.

4. An adjustable socket assembly for a ratchet wrench useful for torqueing a nut (1201) comprising:

a) movable arms (801), wherein said movable arms are designed to contact each face of said nut, b) a cable system, 1) wherein said cable system is attached to said movable arms and is designed to adjust the position of said movable arms for varying sizes of nuts, and 2) wherein said cable system is designed to be adjusted by the relative rotation of two part assemblies (401, 402), c) cable guides (802, 803), wherein said cable guides are incorporated into said movable arms, d) wherein said cable system is attached to a top gear plate (301), e) wherein said cable system is attached to a bottom gear plate (502), f) wherein said top gear plate and said bottom gear plate are fitted inside a socket top (100), g) wherein said movable arms are attached to an arm carrier (810), and h) wherein said arm carrier fitted inside said socket top.

* * * * *